United States Patent [19]

Laven

[11] 4,084,272

[45] Apr. 18, 1978

[54] SWIMMING POOLS WITH OVERFLOW GUTTERS

[76] Inventor: Merrill L. Laven, 4 Marion Ave., Albany, N.Y. 12203

[21] Appl. No.: 651,245

[22] Filed: Jan. 22, 1976

Related U.S. Application Data

[62] Division of Ser. No. 428,882, Dec. 27, 1973, Pat. No. 3,938,199.

[51] Int. Cl.[2] ..... E04H 3/16; E04H 3/18

[52] U.S. Cl. ..... 4/172.17; 4/172.21; 4/172.18; 52/169.5; 52/282; 52/588

[58] Field of Search ..... 4/172.19, 172, 172.21, 4/172.17, 172.18, 173; 52/169, 282, 288, 309, 495, 588

[56] References Cited

U.S. PATENT DOCUMENTS

| | | | |
|---|---|---|---|
| 3,319,264 | 5/1967 | Scarano | 4/172.17 |
| 3,396,500 | 8/1968 | Lankheet | 52/169 |
| 3,557,391 | 1/1971 | West | 4/172.21 |
| 3,667,071 | 6/1972 | Hoch | 4/172.21 |
| 3,668,712 | 6/1972 | Baker | 4/172.17 |
| 3,668,714 | 6/1972 | Baker | 4/172.17 |
| 3,753,327 | 8/1973 | Orndorff | 4/172.19 X |
| 3,785,099 | 1/1974 | Greene | 4/172.21 |
| 3,811,236 | 5/1974 | Fiddes | 4/172.21 |
| 3,815,160 | 6/1974 | Baker | 4/172.17 |
| 3,908,207 | 9/1975 | Van den Brocek | 4/172.17 |
| 3,968,527 | 7/1976 | Hough | 4/172.17 |

*Primary Examiner*—Henry K. Artis
*Attorney, Agent, or Firm*—Steinberg & Blake

[57] ABSTRACT

A swimming pool includes an elongated plastic extrusion of channel-shaped configuration forming a gutter for receiving liquid which overflows from the pool. This gutter has an outer upper region connected with a concrete-retaining structure.

6 Claims, 8 Drawing Figures

200
192
198
186
196
190
188
130
182
164
124
3
76
122
132
158
154
156
172
174
60
22
74
34
104
110
2
108
106

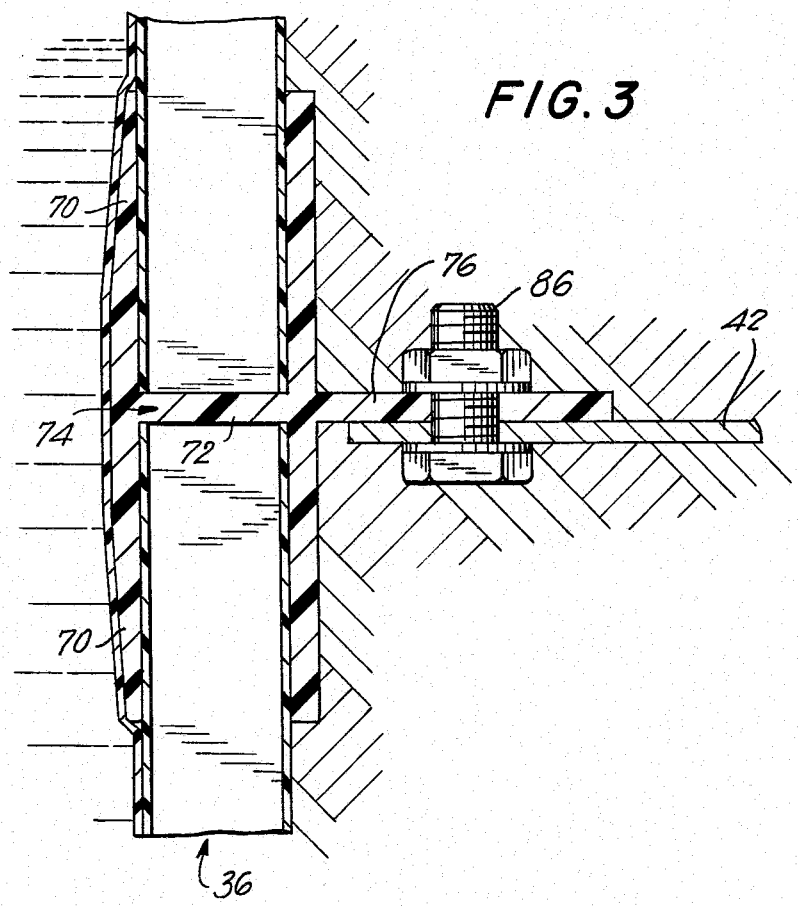
FIG. 3
FIG. 4
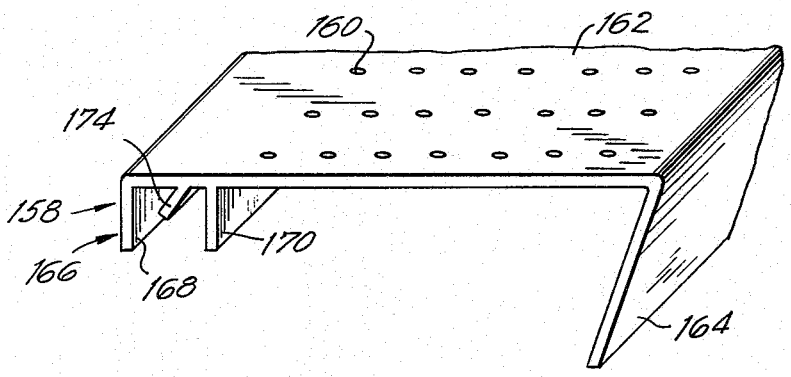

FIG. 5
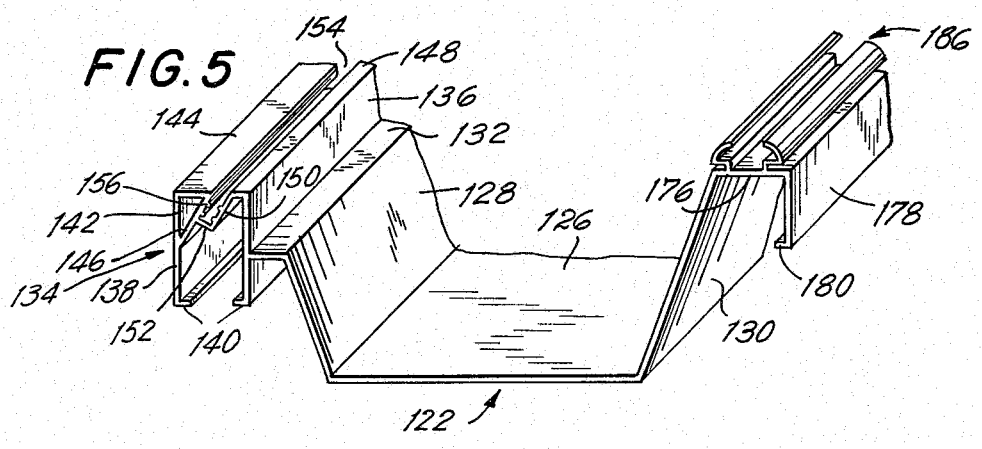
FIG. 7
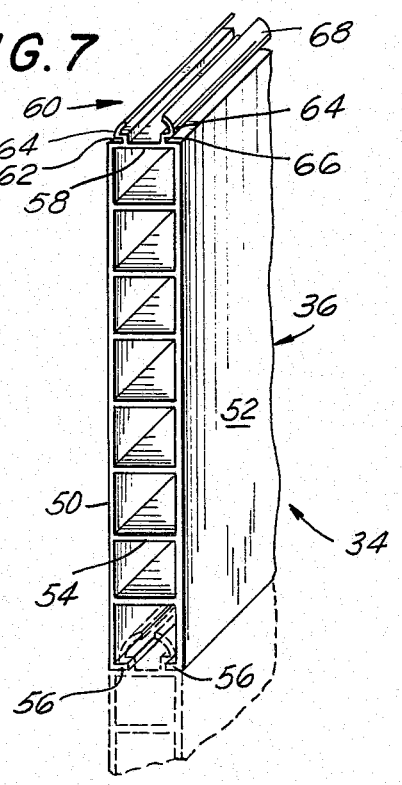
FIG. 6
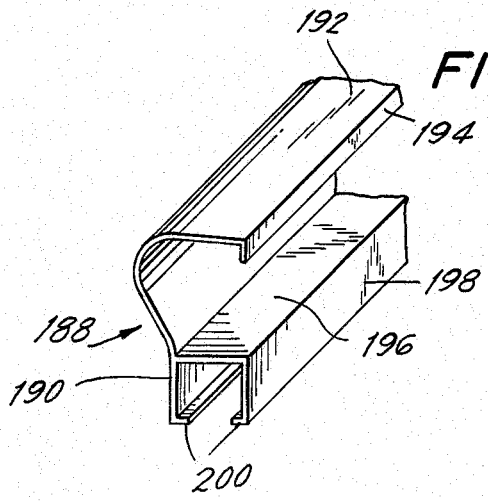
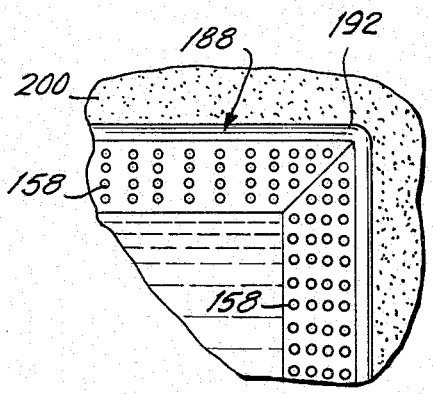
FIG. 8

SWIMMING POOLS WITH OVERFLOW GUTTERS

CROSS REFERENCE TO RELATED APPLICATION

This application is a division of copending application Ser. No. 428,882, filed Dec. 27, 1973 now Pat. No. 3,938,199.

BACKGROUND OF THE INVENTION

The present invention relates to swimming pools.

In particular, the present invention relates to components which may be assembled together to form at least that part of a swimming pool which is concerned with the circulation of the water therein.

Thus, at the present time certain inconveniences and problems are encountered with respect to circulation of pool water for filtering purposes. Pool constructions which include a plastic liner sheet and a backing, such as a metal backing, therefor do not lend themselves to use of an overflow gutter. Therefore it is customary with such constructions to provide an opening in the side of the pool for attachment of a skimmer installation through which water can flow out of the pool to be filtered before being returned to the pool. The attachment of such a skimmer installation itself creates problems because of the complexity of such installations and the inconvenience in connection with the attachment thereof to a metal pool wall.

SUMMARY OF THE INVENTION

It is accordingly a primary object of the present invention to provide a swimming pool made up of components which can be assembled to form a pool of practically any desired configuration while at the same time avoiding the drawbacks referred to above.

In particular, it is an object of the present invention to provide a pool construction of the above type which can conveniently be associated with a gutter assembly into which the pool water can overflow so that inconveniences in connection with skimmer installations can be avoided.

It is also an object of the present invention to provide a pool construction which lends itself to use with a concrete deck.

In addition it is an object of the present invention to provide a pool construction where practically all of the components, except for a plastic liner sheet and some anchoring elements, can conveniently and inexpensively be manufactured from plastic extrusions, so that the pool can be assembled of light-weight inexpensive parts.

According to the invention there is used in the swimming pool an elongated plastic extrusion of channel-shaped configuration forming a gutter for receiving liquid which overflows from the pool. This gutter has an outer upper region, and a concrete-retaining means is connected with this outer upper region of the gutter.

BRIEF DESCRIPTION OF DRAWINGS

The invention is illustrated by way of example in the accompanying drawings which form part of this application and in which:

FIG. 3 is a fragmentary sectional plan view taken along line 3—3 of FIG. 2 in the direction of the arrows and showing how a pair of successive units of a backing means are joined to each other as well as illustrating in part how bracing and anchoring is achieved;

FIG. 4 is a fragmentary perspective illustration of a cover means for a gutter as well as part of a connecting means for the top of a plastic liner sheet;

FIG. 5 is a fragmentary perspective illustration of an extrusion forming part of a gutter and the remainder of the sheet-connecting means which cooperates with part of the structure of FIG. 4;

FIG. 6 is a fragmentary perspective illustration of a concrete-retaining means capable of being assembled with the upper outer portion of the gutter extrusion of FIG. 5;

FIG. 7 is a fragmentary perspective illustration of one of the extrusions of a unit of a backing means, with part of the next-lower extrusion shown in phantom lines; and FIG. 8 is a fragmentary top plan view of a corner of a finished pool illustrating a miter connection which may be utilized.

DESCRIPTION OF PREFERRED EMBODIMENTS

Figures 1, 2:
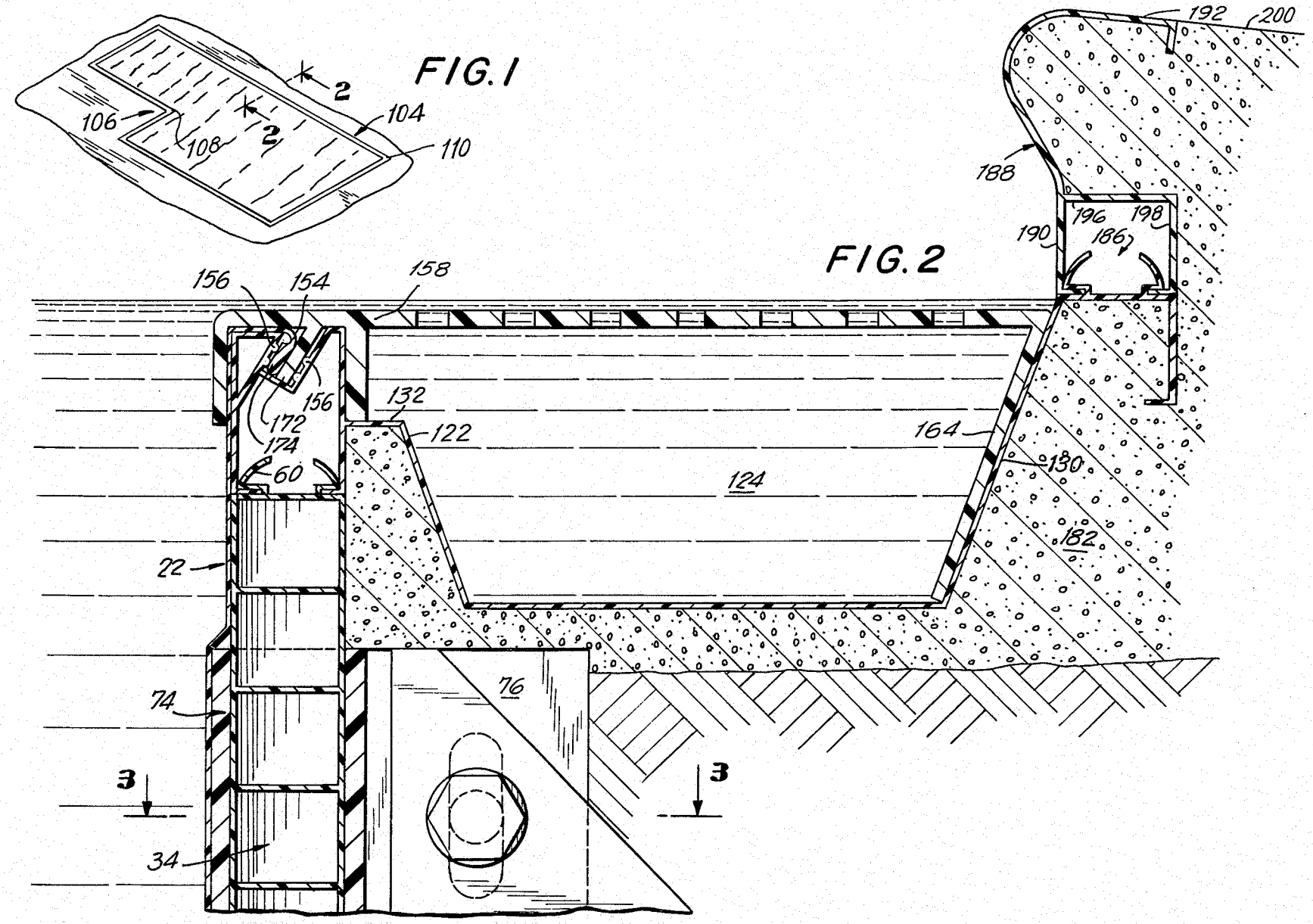
FIG. 1 is a fragmentary perspective illustration of a pool having one of many possible configurations.
FIG. 2 is a fragmentary vertical sectional view taken along line 2—2 of FIG. 1 in the direction of the arrows and showing at a scale which is considerably large as compared to FIG. 1 the manner in which various components of the invention are assembled and supported on the ground as well as connected with a surrounding concrete deck.

Referring to FIG. 1, there is illustrated therein one possible example of a finished pool 104 of the invention, this particular pool 104 having a jog 106 providing the pool with an inwardly directed corner 108 in addition to the remaining corners 110.

As is apparent from FIG. 2, the interior of the pool is provided with a plastic liner sheet 22 supported at its outer surface by a backing means 34 made up, as shown in FIG. 7, of a series of extrusion units 36. Each of these units has an inner vertical wall 50, and outer vertical wall 52 and a plurality of horizontally extending walls 54 interconnecting the walls 50 and 52. The uppermost transverse wall 58 is integrally formed with a springy connecting means 60 in the form of springy connecting tongues 68 having at their lower regions inwardly curved portions 64 which define with the wall 58 longitudinally extending horizontal grooves 62 and 66. At the lower end of each unit 35 there are a pair of inwardly directed flanges 56 which are snapped into the grooves 62 and 66 in the manner apparent from FIG. 7 so that in this way each section of the backing means 34 is assembled.

In order to interconnect the several sections of the backing means, a connecting means as shown in FIG. 3 is provided. This connecting means includes a vertically extending plastic wall structure 76 extending rearwardly and outwardly from an elongated vertically extending structure 74 having a central transverse vertical wall 72 and inner and outer walls 70 providing the substantially H-shaped cross section shown in FIG. 3. One of the units 36 is situated on one side of the transverse wall 72 between the inner and outer wall portions 70 and in engagement with the transverse wall 72 of the connecting structure 74 while the next unit is situated at the other side of the wall 72 in the manner shown in FIG. 3. The outwardly extending vertical wall 76 is joined as by fasteners 86 with an anchoring structure 42. The plastic liner sheet 22 engages the backing means 34 as well as the connecting means 74 therebetween in the manner shown in FIG. 2 and described in greater detail below.

Irrespective of the particular configuration of the pool, it will have an upper structure as illustrated in FIG. 2. Referring to FIG. 2 it will be seen that all along the upper periphery of the pool there is a gutter formed by extrusion sections 122 having the illustrated channel-shaped configuration and joined one to the next as by butting against each other. The configuration of these channel-shaped extrusion sections 122 which form the overflow gutter 124 is shown most clearly in FIG. 5. Thus, as may be seen from FIG. 5, the channel-shaped gutter extrusion 122 has a bottom wall 126 and a pair of outwardly and upwardly inclined walls 128 and 130 which extend upwardly and outwardly from the inner and outer edges of the bottom wall 126.

The upper edge of the wall 128 is integrally extruded with an inwardly extending wall portion 132 which in turn is integrally extruded with a sheet-connecting means 134.

The sheet-connecting means 134 includes a vertical wall 136 extending perpendicularly across the wall 132 and extending parallel to an inner vertical wall 138. These walls 136 and 138 terminate at their lower edges in inwardly directed flanges 140 which are snapped onto the springy connecting means 60 of the uppermost extrusion of each unit of the backing means, as shown most clearly in FIG. 2. Thus, the flanges 140 cooperate with the springy connecting means 60.

The upper region of the inner wall 138 of the sheet-connecting means 134 is in the form of an elongated hollow triangular extrusion portion 142 forming an upper wall part 144 and an inclined wall 146 extending between the wall portion 144 and the vertical wall 138. The inner wall 136 of the sheet-connecting means 134 has an inwardly extending upper wall portion 148 which is integral with an inclined wall portion 150 which is parallel to the inclined wall portion 146, these walls 146 and 150 being interconnected by a wall portion 152 which is integral with the wall portions 146 and 150 and which defines therewith a groove extending downwardly from the top wall of the connecting means 134, this top wall being formed by the portions 144 and 148. Thus, the sheet-connecting means 134 is in the form of a one-piece extrusion which is extruded integrally with the channel extrusion 122 which forms the gutter 124, and this connecting means 134 has the groove 154 which is inclined downwardly and inwardly toward the interior of the pool, as is apparent particularly from FIG. 2.

All of the above extrusions which are used to form the various components of the pool can be manufactured from any desired plastic such as polyvinyl chloride. This plastic wall will the most part be rigid in the finished components. However, in accordance with a particular feature of the invention the walls 146 and 150 are extruded in a known way, with the remainder of the extrusion shown in FIG. 5, in such a way that these walls 146 and 150 have extruded therewith longitudinally extending beads 156 which although extruded integrally with the remainder of the extrusion simultaneously therewith are nevertheless of a softer material which remains resilient and yieldable. Such extrusions which have a material which in part is rigid and in part is soft and elastic are known. Thus the extrusion which forms the connecting means 134 and the gutter channel 122 also has the elastic beads 156 as an integral part thereof. Thus a number of these beads will be located at each side of the groove 154.

The overflow gutter 124 is covered by sections of a plastic cover means 158 which also may be extruded. The cover means 158 is shown most clearly in FIG. 4. In this case also the extruded material is cut into suitable lengths which are situated one next to each other over the gutter 122 so as to cover the latter. The extruded material is however punched through with a number of openings 160 so that the overflow water can fall through these openings 160 into the gutter 124 filling the latter as shown in FIG. 2, while at the same time larger articles such as leaves, twigs, and the like, will be prevented by the openings 160 from entering into the gutter 124. This gutter 124 communicates with an unillustrated pipe system through which the water from the gutter is conveyed through a filter before being returned to the pool, a suitable pump being provided for this purpose.

The cover means 158 thus has the top wall portion 162 which is formed with the openings 160. This top wall portion 162 is integrally joined at its outer edge to an inwardly and downwardly inclined wall 164 which has the same inclination as the wall 130 and which rests against the wall 130 as illustrated in FIG. 2.

At its inner edge region the extrusion 158 is formed with a cover portion 166 which covers the upper part of the connecting means 134 and which cooperates therewith to form part of the structure for connecting the upper edge region of the plastic liner sheet 22 to the sheet-connecting means 134. For this purpose the front region 166 is in the form of a downwardly directed channel which is seated on and snugly fits against the upper part of the connecting means 134 which extends above the wall 132. Thus, the portion 166 has inner and outer walls 168 and 170 which form a channel between which the upper end of the connecting means 134 is received. Also, between these walls 168 and 170 the cover means 158 has an integral inwardly and downwardly inclined tongue 172 which extends into the groove 154 in the manner shown most clearly in FIG. 2. Thus, the extrusion 158 will be extruded in one piece so as to have the configuration shown in FIG. 4 and will be cut into suitable lengths which can be placed one next to the other along the periphery of the pool. Of course, where the pool is curved the extrusions 158 will be suitably curved by being placed against suitable forms while they are still of sufficient pliability upon issuing from the extruder.

As is shown most clearly in FIG. 2, the liner sheet 22 has an upper edge region 174 in the form of a bead which is thicker than the remainder of the liner sheet 22. When the components of the pool are assembled, the sheet 22 is placed against the backing means 34, and in a known manner a suitable vacuum pipe can be applied between the sheet 22 and the backing means to extract any residual air which may remain so that the liner sheet will snugly rest against the inner surface of the backing means. The upper thicker edge 174 of the liner sheet 172 is introduced into the groove 154 all around the periphery of the pool, and then the cover means 158 is assembled with the remaining structure as illustrated in FIG. 2. The thickness of the tongue 172 is such that together with the thickness of the edge 174 of the sheet 22, the total thickness of these parts 172 and 174 is greater than the distance between the beads 156 at opposite sides of the groove 154. As a result after the thicker edge 174 of the sheet 22 is placed in the groove 154 and the tongue 172 is then introduced, the edge 174 is pressed against the left beads 156 of FIG. 2, while the tongue 172 is pressed against the right beads 156 of FIG. 2, these beads becoming deformed and compressed so that with this construction a tight connection of the sheets 22 is achieved. The tightness is achieved not only by reason of the fact that the sheet 22 snugly rests against the backing means going around the upper edge of the connecting means 134 and down into the groove 154, with the sheet being held in this manner by the front channel portion 166 of the cover means 158, but in addition an extremely effective tightness is achieved by the compression of the beads 156. As a result with this construction even though the water in the pool continuously overflows into the gutter 124 in the manner described above, it is not possible for any water to gain access to a location situated between the sheet 22 and the backing means 34, so that the possibility of any water becoming situated behind the sheet 22 with all of the problems resulting therefrom is reliably prevented.

It is possible in a very convenient manner to provide the pools of the invention with a concrete deck. Thus, once the structure as described above is assembled the earth which has been removed will be filled in around the structure so that an arrangement as shown in FIG. 2 will be achieved. In fact as the water is introduced and the level thereof rises up in the pool the earth is filled in so as to always be during initial setting up of the pool at least as high as the level of the water in the pool. When the earth has been filled in approximately to the height of the top ends of the flanges 76, the earth-filling or packing operations are terminated and concrete is then poured to achieve a construction as shown in FIG. 2.

For this purpose the extrusion channel 122 which forms the gutter 124 is extruded integrally with an outer horizontally extending flange 176 which in turn is integrally extruded with a downwardly extending outer wall or flange 178 terminating in an inwardly directed lower flange 180, so that in this way the gutter channel 122 will become reliably and solidly embedded in the concrete 182 when the latter solidifies after pouring. The top outer wall 176 of the single extrusion shown in FIG. 5 is integrally extruded with a springy connecting means 186 which may be identical with the springy connecting means 60 described above and shown in FIG. 6. This spring connecting means 186 serves to connect to the outer portion of the gutter channel 122 a concrete retainer extrusion 188 shown most clearly in FIG. 6. The concrete retainer means 188 has an inner wall 190 which has a lower vertical portion and an upper portion which curves inwardly and then outwardly to form the upper horizontal wall portion 192 which terminates in the downwardly and inwardly directed flange 194. As is shown most clearly in FIG. 2, the upper wall portion 192 is inclined downwardly and outwardly away from the pool. This wall 190 is extruded integrally with a rearwardly extending wall portion 196 which in turn is extruded integrally with a downwardly extending wall portion 198. The walls 190 and 198 terminate at their lower edges in a pair of inwardly directed flanges 200 adapted to snap over the springy tongues of the springy connector means 186 in precisely the manner described above in connection with the flanges 56 and the springy connector means 60. In this way the concrete retainer means 188 can be readily assembled with the outer upper portion of the gutter extrusion in the manner shown most clearly in FIG. 2.

With the parts thus assembled and with suitable supports such as blocks or the like situated at given intervals beneath the gutter extrusion 122 so as to temporarily support the latter at the required elevation, the concrete 182 is poured so as to assume the configuration shown in FIG. 2, and the upper surface 200 which forms the concrete deck is inclined downwardly and outwardly to form a continuation of the upper surface of the wall 192 of the concrete retainer means 188. In this way the concrete deck will be pitched properly so as to cause any water or rain which falls on the deck surface 200 to flow outwardly away from the pool. The wall 192 is the region where an individual will stand preparatory to jumping into the pool, for example. Of course any diving board can be mounted adjacent the pool of the deep end thereof.

As may be seen from FIG. 8, when the parts are assembled, the components such as the cover extrusions 158, the concrete retainer extrusions 188, and the gutter extrusions 122 are suitable mitered so as to butt against each other at the corners in the manner illustrated in FIG. 8. Prior to pouring of the concrete suitable tape may be placed across the mitered connections to hold them together in sealed relation while the concrete sets, and thereafter this tape may be removed if desired.

What is claimed is:

1. For use with a swimming pool, an elongated plastic extrusion of channel-shaped configuration forming a gutter for receiving liquid which overflows from the pool, said gutter having an outer upper region, and concrete-retaining means connected with said outer upper region of said gutter and extending upwardly from said outer upper region of said gutter, said concrete-retaining means having at an elevation higher than said outer upper region of said gutter an outwardly directed hollow interior for receiving concrete, said concrete-retaining means being itself in the form of a plastic extrusion, the latter having a lower end provided with a pair of opposed inwardly directed flanges, and said outer upper region of the gutter having springy tongues for extending around and releasably holding said flanges connected to said gutter.

2. The combination of claim 1 and wherein said gutter has an inner region including an upper connecting means for fluid-tightly connecting the upper edge of a plastic liner sheet to the gutter.

3. The combination of claim 2 and wherein a cover is situated over said gutter and is itself in the form of a plastic extrusion separate from said plastic extrusion which forms said gutter so as to be removable from said gutter, said cover having an inner edge region in the form of a downwardly directed channel which forms part of said connecting means.

4. The combination of claim 3 and wherein said cover has over said gutter a wall formed with a plurality of openings through which water can flow while retaining above said cover larger particles such as leaves, twigs, and the like.

5. The combination of claim 4 and wherein said gutter has an outer lower region in the form of an inclined wall while said cover also has an outer lower region in the form of an inclined wall engaging said inclined wall of said gutter.

6. The combination of claim 1 and wherein a body of concrete is retained by said concrete-retaining means and extends beneath and supports said gutter.

* * * * *